US005242355A

United States Patent [19]

Costa

[11] Patent Number: 5,242,355

[45] Date of Patent: Sep. 7, 1993

[54] EXERCISE APPARATUS

[76] Inventor: Kathleen Costa, 159 Blackamore Ave., Cranston, R.I. 02910

[21] Appl. No.: 415

[22] Filed: Jan. 4, 1993

[51] Int. Cl.[5] ..... G06M 1/00

[52] U.S. Cl. ..... 482/141; 377/5

[58] Field of Search ..... 482/141, 909, 142, 51, 482/52, 84, 74; 73/379.01, 379.04, 379.08; 377/5, 6, 15

[56] References Cited

U.S. PATENT DOCUMENTS 4,700,369 10/1987 Siegal et al. ..... 377/5 X
4,974,833 12/1990 Hartman et al. ..... 482/84 X
5,158,512 10/1992 Irwin et al. ..... 482/142 X

*Primary Examiner*—Richard J. Apley
*Assistant Examiner*—Glenn E. Richman
*Attorney, Agent, or Firm*—Salter, Michaelson & Benson

[57] ABSTRACT

Exercise apparatus includes a counting device for counting the number of push-up completed during a period of exercise and a plurality of platform elements. The counting device comprises a housing, a digital counter mounted in the housing and a button switch mounted on the top of the housing. The counter is positioned on a supporting surface beneath the chest of the person performing the push-ups and it is incremented each time a person lowers his/her chest to contact the top of the housing when doing a push-up. The platform elements are stackable one on top of another and the counting device is stackable on top of the uppermost platform element to enable the user to adjust the vertical height of the counting device above a supporting surface.

8 Claims, 2 Drawing Sheets

EXERCISE APPARATUS

BACKGROUND OF THE INVENTION

The instant invention relates to exercise apparatus and more particularly to a device for counting push-ups.

Performing a plurality of push-ups is a common form of exercise which serves to strengthen the muscle groups of the upper body, especially the arms, the chest, and the abdomen. However, it has been found that many people do not perform push-ups correctly and therefore they do not obtain the full benefit of the exercise. Further, it has been found that incorrectly performing push-ups over an extended period of time may lead to muscular and/or skeletal injury. Still further, it has been found that people often do not accurately count the number of push-ups they have performed during a specific period of exercise.

SUMMARY OF THE INVENTION

The instant invention provides exercise apparatus which enables the user to gradually increase his/her strength while performing push-ups, and which provides a means of accurately counting the number of push-ups completed during a work-out period.

Briefly, the exercise apparatus comprises a counting device, and a plurality of platform elements for adjusting the vertical height of the counting device. The counting device comprises a digital counter which is mounted in a housing, and a switch assembly which is mounted on the top of the housing for incrementing the digital counter. The counting device further includes a padded cushion which is extended over the switch assembly and secured to the housing. The platform elements generally correspond in shape to the housing of the counting device, and they are stackable, one on top of another. The counter device is stackable on the uppermost platform element.

For use of the counting device by itself, the counting device is placed on the floor, and the user places his/her hands on the floor to the left and right sides of the device. The user then assumes the push-up position, making sure that his/her chest is aligned directly above the padded cushion, and lowers himself/herself downwardly so that his/her chest makes physical contact with the padded cushion. The pressure of the user's chest on the padded cushion actuates the switch assembly which in turn increments the digital counter. The digital counter is incremented one digit each time the user's chest makes contact with the padded cushion.

The platform elements enable the user to adjust the height of the counting device. Raising the height of the counting device decreases the distance which the chest must be lowered and therefore makes the push-ups easier to perform. On the other hand, lowering the counting device increases the distance which the chest must be lowered thereby making the push-ups more difficult to perform.

Accordingly, it is an object of the instant invention to provide a device for counting the number of push-ups completed during a work-out period.

It is another object to provide an exercise device which enables the user to gradually build up strength while performing push-ups.

It is another object to provide a device for counting push-ups which is adjustable in height.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
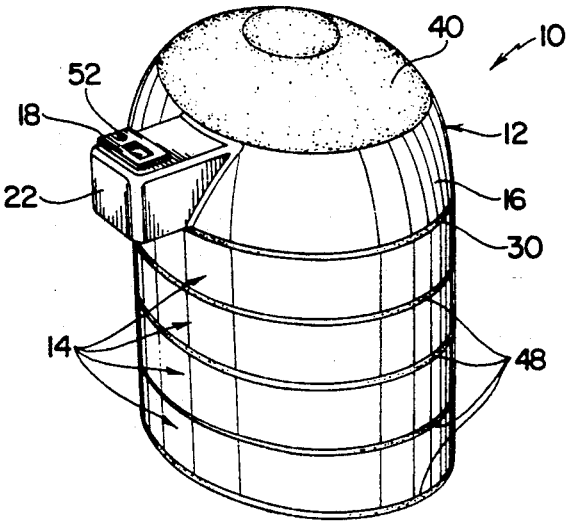
FIG. 1 is a perspective view of the exercise apparatus of the instant invention.
Figure 2:
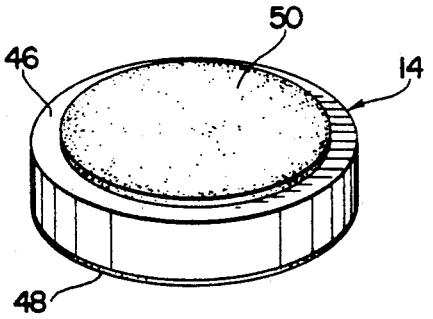
FIG. 2 is a perspective view showing the upper surface of one of the platform elements.
Figure 3:
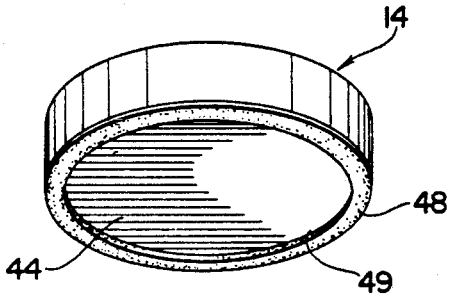
FIG. 3 is another perspective view showing the lower surface one of the platform elements.

Referring now to the drawings, the exercise apparatus of the instant invention is illustrated generally at 10 in FIG. 1. As will hereinafter be more fully disclosed, the exercise apparatus 10 is operative for gradually increasing the user's strength, and for counting the number of push-ups completed during a work-out period. The exercise apparatus 10 comprises a counting device generally indicated at 12 in FIGS. 1 and 4, and a plurality of platform elements generally indicated at 14 in FIGS. 1, 2 and 3.

Figure 4:
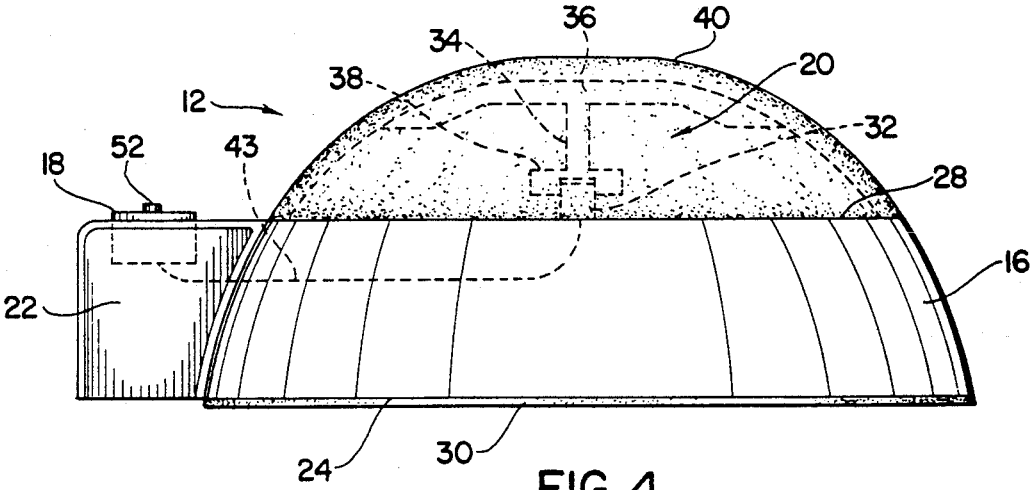
FIG. 4 is an enlarged elevational view of the counting device with the digital counting device and button switch shown in broken lines.

Referring now to FIGS. 1 and 4, the counting device 12 comprises a housing 16, a digital counter 18, and a switch assembly generally indicated at 20 for incrementing the digital counter 18. The housing 16 is preferably generally oval in shape, and it has a rectangular shaped appendage 22 which extends outwardly from one side thereof. The housing 16 and appendage 22 are preferably integrally molded from a rigid, durable plastic. The housing 16 includes a flat base 24 for supporting the housing 16 on a supporting surface 26 (FIGS. 5 through 9) such as a floor, and it also has a top portion 28. A hard rubber strip 30 is secured around the outer peripheral edge of the base 24 so that it defines a recessed cavity (not shown) on the base 24 of the housing 16. The strip 30 is effective for preventing sliding movement of the housing 16 on the supporting surface 26. The digital counter 18 is mounted in the appendage 22, and it preferably comprises a conventional digital counter with a liquid crystal display for displaying the number of push-ups completed during a work out period.

The switch assembly 20 comprises a button-type or push-button switch 32, which is mounted on the top portion 28 of the housing 16, and an elongated plunger arm 34 having an enlarged impact surface 36 at one end thereof and a cupped housing 38 at the other end thereof. The cupped housing 38 is received over the button switch 32, and the impact surface 36 faces upwardly. The counting device 12 further includes a padded cushion 40 which is extended over the impact surface 36 of the plunger arm 34 and is secured to the housing 16. The padded cushion 40 provides a soft contact surface when a person 42 (FIGS. 5 through 9)

lowers his/her chest onto the top 28 of the counting device 12 while performing a plurality of push-ups. The push-button switch 32 is electrically interconnected to the digital counter 18 via an electrically conductive wire 43 so that the digital counter 18 is incremented whenever the button switch 32 is actuated by physical contact with the plunger arm 34 through the padded cushion 40. It is pointed out that the overall height of the counting device 12 is preferably four inches, i.e. the top of the padded cushion 40 is four inches above of the supporting surface 26.

The plurality of platform elements 14 are stackable one on top of another, and the counting device 12 is receivable on top of the uppermost platform element 14 so that the height of the counting device 12 above the supporting surface 26 may be adjusted (See FIG. 1). The platform elements 14 are generally oval in configuration so that they correspond in shape to the housing 16 of the counting device 12, and they are preferably molded from a rigid durable plastic. Each platform element is two inches in height and includes a flat lower surface 44 for supporting the platform element 14 on a supporting surface 26, and an upper surface 46. A hard rubber strip 48 is secured around the outer peripheral edge of the lower surface 44 so that it defines a recessed cavity 49 on the lower surface 44. The strip 48 is effective for preventing sliding movement of the platform element 14 on the supporting surface 26. The upper surface 48 of each platform element 14 includes a raised neck portion 50 which generally corresponds in dimension to the recessed cavity on the base 24 of the counter housing 16 and the recessed cavity 49 on the lower surface 44 of the platform element 14. The platform elements 14 are stackable one on top of another wherein the recessed cavity 49 of one platform element 14 is received in interfitting engagement over the raised neck portion 50 of another platform element 14 (See FIG. 1). The counter device 12 is stackable on the uppermost platform element 14 so that the recessed cavity on the base 24 of the housing 16 is received in interfitting engagement over the raised neck portion 50 of the uppermost platform element 14 (See also FIG. 1).

Figure 7:
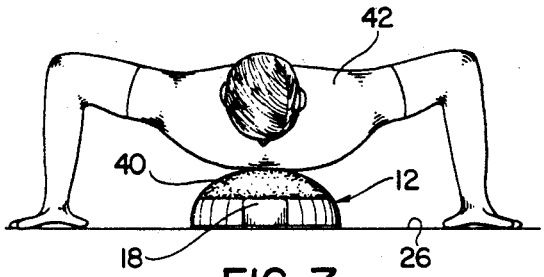

For use of the counting device 12 by itself, the counting device 12 is placed on the floor 26 with the digital counter 18 facing upwardly, and the user 42 places his/her hands on the floor 26 to the left and right sides of the device 12 (See FIG. 7). The user 42 then assumes the push-up position, i.e. arms extended and chest suspended above the floor 26, making sure that his/her chest is directly above the padded cushion 40. The user 42 then lowers himself/herself downwardly so that his/her chest makes physical contact with the padded cushion 40. The pressure of the user's chest on the padded cushion 40 moves the plunger arm 34 downwardly to actuate the button switch 32, which in turn increments the digital counter 18. The user 42 then lifts his/her chest upwardly to complete the push-up. The push-ups are repeated until the desired number have been completed. The digital counter 18 is incremented one digit each time the user's chest makes contact with the padded cushion 40. A reset button 52 is provided on the digital counter 18 to reset the counter 18 to zero each time the counting device 12 is used.

Figure 5:
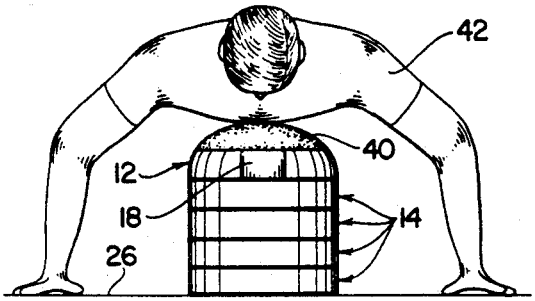
FIGS. 5 through 9 are elevational views of the exercise apparatus with the platform elements arranged in different configurations to vary the height of the counting device.
Figure 6:
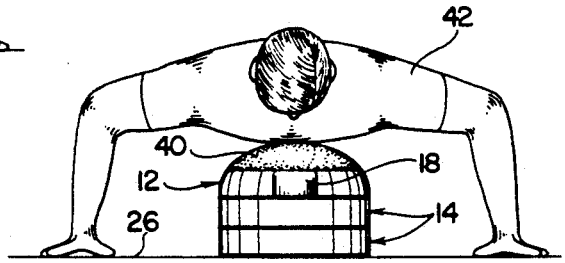

As illustrated in FIGS. 5 through 9, the platform elements 14 enable the user 42 to vary the height of the counting device 12 above the supporting surface 26. In this regard, raising the height of the counting device 12 reduces the distance which the chest must be lowered to contact the padded cushion 40, thus making the push-ups easier to perform. On the other hand, lowering the counting device 12 increases the distance which the chest must be lowered and thus makes the push-ups more difficult to perform. To raise the vertical height of the counting device 12 above the supporting surface 26 (See FIGS. 5 and 6), a number of platform elements 14 are chosen and stacked one upon another on the supporting surface 26 until a desired height is achieved, and then the counting device 12 is stacked upon the uppermost platform element 14. In FIG. 5, it can be seen that the height of the counting device 12 is raised to twelve inches (four inches for the counting device 12 and two inches for each of the four platform elements 14), and in FIG. 6, it can be seen that the height is raised to eight inches. The user 42 places his/her hands on the floor 26 to the left and right sides of the counting device 12 and assumes the position for performing push-ups, i.e. arms extended so that the user's chest is positioned directly over the padded cushion 40 of the counting device 12. As explained previously, the user 42 then lowers his/her chest downwardly onto the padded cushion 40 on the counting device 12 wherein the button switch 32 is actuated and the digital counter 18 is incremented one digit. In a beginner stage, the user 42 would place all four platform elements 14 under the counting device 12. As strength is developed, the platform elements 14 may be removed, one at a time, until the user 42 is proficient at performing normal push-ups.

Figure 9:
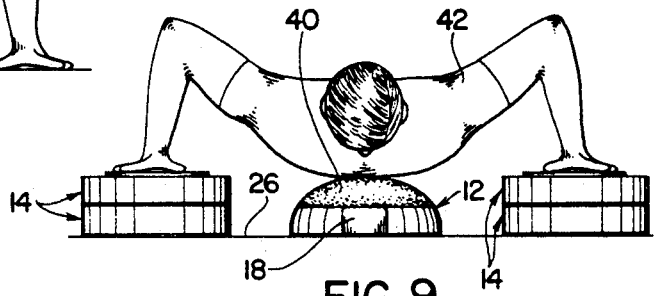
Figure 8:
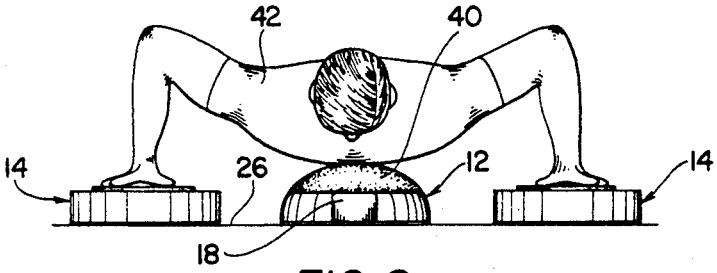

For those who are already proficient at performing push-ups, the platform elements 14 can be utilized to lower the effective height of the counting device 12. In this regard, the platform elements 14 are stacked in equal numbers to the left and right sides of the counting device 12, and the user's hands are positioned on top of the platform elements 14. In FIGS. 8 and 9, it can be seen that the counting device 12 is placed on the floor 26 and the platform elements 14 are stacked to the left and right sides of the device 12. This arrangement of the platform elements 14 effectively lowers the height of the counting device 12 by artificially raising the level of the supporting surface 26. In FIG. 9, two platform elements 14 are stacked to each side of the counting device 12 so that the effective height of the counting device 12 is zero inches, i.e. the top of the counting device 12 is four inches above the supporting surface 26 and the user's hands are also four inches above the supporting surface 26. This arrangement is roughly the equivalent of lowering your chest to the floor when performing a normal push-up without the exercise apparatus 10. It can thus be seen that the platform elements 14 enable a user to progress from a beginner stage wherein the user 42 is unable to do a full push-up (FIG. 5) to an advanced stage wherein the user 42 is able to complete a full push-up (FIG. 9).

It is seen therefore that the instant invention provides exercise apparatus 10 which is effective for gradually increasing strength in the muscle groups of the upper body, and for counting the number of push-ups completed during a period of exercise. The digital counting device 18 accurately and automatically counts the number of push-ups performed by incrementing the counter 18 when the user 42 lowers his/her chest and makes contact with the device 12. The platform elements 14 of the apparatus 10 enable the user 42 to adjust the height of the counting device 12 so that the user can gradually increase strength. For these reasons, it is believed that the exercise apparatus 10 of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. Exercise apparatus comprising:

housing means having a base portion for supporting said housing means on a supporting surface and said housing having a top portion;

counter means on said housing;

sensor means on the top portion of said housing means for sensing physical contact with the top portion of said housing means, said sensor means being connected to said counter means wherein said counter means is incremented when a person makes physical contact with the top portion of said housing means during a push-up; and a plurality of platform elements each having a lower surface for supporting said platform element on a supporting surface and an upper surface, said platform elements being stackable, one on top of another, wherein the lower surface of one platform element is received on the upper surface of another of said platform elements, said base portion of said housing means being adapted to be received on the upper surface of an uppermost platform element.

2. In the exercise apparatus of claim 1, said counter means comprising a digital counter, said sensor means comprising a button switch positioned on the top portion of said housing means, and a plunger arm mounted on said button switch, said button switch being electrically interconnected with said digital counter means wherein said digital counter means is incremented when said button switch is actuated.

3. The exercise apparatus of claim 2 further comprising padded cushion means on the top portion of said housing means, said padded cushion means extending over said plunger arm and said button switch and being secured to said housing means.

4. In the exercise apparatus of claim 1, said base portion of said housing means having a recessed cavity therein, said lower surface of said platform elements having a recessed cavity therein, said upper surface of said platform elements having a raised neck portion generally corresponding in dimension to said recessed cavity in said base portion of said housing means and said recessed cavity in said lower surface of said platform element, said platform elements being stackable one on top of another wherein the recessed cavity of one platform element is received in interfitting engagement on the raised neck portion of another platform element, said housing means being stackable on top of an uppermost platform element wherein the recessed cavity of the base portion of the housing means is received in interfitting engagement with the raised neck portion of said uppermost platform element.

5. In the exercise apparatus of claim 1, said base portion of said housing means and said lower surface of said platform elements each including gripping means for preventing movement of the housing means and the platform elements with respect to each other and with respect to the supporting surface.

6. In the exercise apparatus of claim 5, said gripping means comprising a resilient rubber strip disposed around an outer peripheral edge of the base portion of the housing means and an outer peripheral edge of the lower surface of the platform elements.

7. Exercise apparatus comprising:

housing means having a base portion for supporting said housing means on a supporting surface and said housing having a top portion;

counter means on said housing; and sensor means on the top portion of said housing means for sensing physical contact with the top portion of said housing means, said sensor means being connected to said counter means wherein said counter means is incremented when a person makes physical contact with the top portion of said housing means during push-up, said counter means comprising a digital counter, said sensor means comprising a button switch assembly positioned on the top portion of said housing means, said switch assembly being electrically interconnected with said digital counter wherein said digital counter is incremented when said button switch is actuated, a plunger arm having a first end mounted over said button switch and a second end facing upwardly, said exercise apparatus further comprising padded cushion means on the top portion of said housing means, said padded cushion means extending over said second end of said plunger arm and being secured to said housing.

8. A push-up counter comprising:

a housing having a generally flat base portion for supporting said housing on a supporting surface, a recessed cavity in said base portion, and said housing having a top portion;

digital counter means mounted in said housing;

button switch means mounted on the top portion of said housing, said button switch means being connected to said digital counter means wherein said counter means is incremented when a person actuates said button switch means during a push-up;

a padded cushion mounted on said top portion of said housing over said button switch;

a plurality of stackable platform elements each including an upper surface having a raised neck portion and a lower surface having a recessed cavity therein, said lower surface being operable for supporting said platform element on a supporting surface, said platform elements being stackable one on top of another wherein the recessed cavity of one platform element is received in interfitting engagement on the raised neck portion of another one of said platform elements, said housing being stackable on the upon an uppermost platform element to adjust the vertical height of the housing means above the supporting surface wherein the recessed cavity in the base portion thereof is received in interfitting engagement on the raised neck portion of the uppermost platform element.

* * * * *